United States Patent [19]

Ames

[11] Patent Number: 4,720,984

[45] Date of Patent: Jan. 26, 1988

[54] APPARATUS FOR STORING COOLING CAPACITY

[75] Inventor: Douglas A. Ames, Huntington Beach, Calif.

[73] Assignee: Transphase Systems, Inc., Huntington Beach, Calif.

[21] Appl. No.: 866,445

[22] Filed: May 23, 1986

[51] Int. Cl.[4] ..... F25D 17/02

[52] U.S. Cl. ..... 62/434; 62/311; 62/438

[58] Field of Search ..... 62/260, 304, 435, 440, 62/434, 438, 311; 165/45

[56] References Cited

U.S. PATENT DOCUMENTS 1,348,352 8/1920 Edwards ..... 62/304

4,011,736 3/1977 Harrison ..... 62/260

*Primary Examiner*—Henry A. Bennet

*Attorney, Agent, or Firm*—Watson, Cole, Grindle & Watson

[57] ABSTRACT

The combination of a cooling tower and a tank containing packaged, eutectoid salt compositions. The tower provides cooled water to freeze the salt compositions, which are later used to chill water for air-conditioning a building.

16 Claims, 1 Drawing Figure

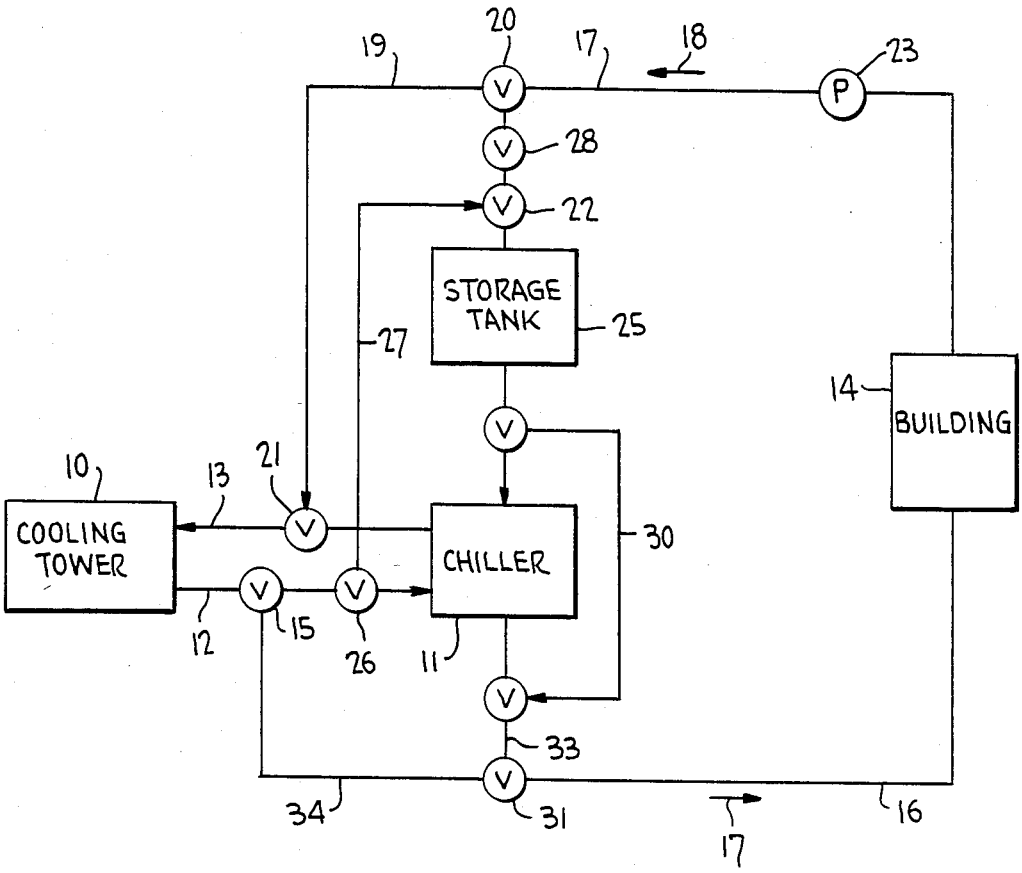
20
19
17
18
23
P
V
28
22
STORAGE TANK
25
27
14
BUILDING
10
13
21
COOLING TOWER
CHILLER
30
12
15
26
11
33
34
31
16
17

APPARATUS FOR STORING COOLING CAPACITY

BACKGROUND OF THE INVENTION

I. Field of the Invention

This application in general relates to apparatus which makes use of certain compositions, generally referred to as phase change materials (PCM's), which change their phase, generally between solid and liquid phases, and thereby store heat energy during such change. More particularly, it refers to apparatus for storing the cooling capacity—actually heat below room temperature—which apparatus makes use of a cooling tower to provide a supply of chilled fluid, usually water, to PCM's.

II. The Prior Art

It has recently become recognized that, while there may be a need for storing heat generated during daytime hours by solar energy, there is an even more immediate need for storing what might be perceived as coolness, i.e., heat energy at temperatures substantially lower than body temperature or room temperature. A class of compositions, which are known as phase change materials, act to store cooling capacity when they have a freezing-melting point below room temperature. As such PCM's melt, they take up heat from the surrounding ambience, and in so doing cool substances within which they are in close contact. Thus, where there is a tank containing packaged PCM's that have a low freezing-melting point, which is sometimes a range of 2 or 3° F., circulating water through the tank and into close proximity, but not contact with the PCM's results in that water being chilled approximately to the melting point of the PCM's.

It is thus recognized that cooling capacity can be stored utilizing PCM's in the form of salt hydrates and additives and modifiers thereto to form eutectoid compositions the freezing-melting points of which can be controlled to a predetermined value. As examples of such PCM's, homogeneous mixtures based on the use of sodium sulfate decahydrate and other ingredients have been described by Dr. Maria Telkes in U.S. Pat. Nos. 2,677,664 and 3,986,969. While such eutectoid salt compositions have not achieved an outstanding degree of economic success at this time, it is believed that their use will become much more widespread in the future.

In arranging PCM's in a tank through which water or other fluid is to be supplied first to freeze and then to be chilled upon melting of the frozen PCM's, it will be apparent that phase change materials such as those including Glauber's salt cannot be permitted to come into direct contact with the fluid, e.g., water. These salt compositons, which rely on a solid-liquid change of phase, are separately packaged. In general, it has been found most advantageous to house such PCM's in separate containers to form packages that will be self-stacking within a tank and which will nest one into the other. In particular, one such package that has been found to be particularly advantageous for use in containing phase change materials is that disclosed in my co-pending application, Ser. No. 696,529, filed Jan. 30, 1985 and entitled, Nestable, Stackable Containers. That application describes nestable, stackable containers adapted to hold PCM's based on sodium sulfate decahydrate in a tank in such a manner that water or other fluid entering the tank will come into good heat exchange relationship with the salt compositions so packaged but, of course, not into direct contact with the salts. By such stackable, nestable containers arranged within the tank, the fluid that is brought into heat exchange relationship with the packaged salts in the tank either gives up its coolness to freeze the salts or, if the fluid is at a temperature greater than the melting point of the salts, to acquire coolness from the frozen salts and thereby be chilled approximately to the melting point of the salts.

Another part of the apparatus which together comprises the present invention is a cooling tower, likewise well-known in the art. In general, a cooling tower is a tower-like device in which atmospheric air circulates in direct or indirect contact with warmer water and thereby cools the water. Cooling towers are often used as heat sinks in refrigeration or steam power generation. They may also be used in any process in which water is a vehicle for heat removal and when it is desirable to make final heat rejection to the atmosphere. Basically, water, acting as the heat-transfer fluid, gives up heat to atmospheric air and, thus cooled, is recirculated through a system, affording economical operation of particular process.

Two basic types of cooling towers are commonly used. One transfers the heat from warmer water to cooler air primarily by evaporation of a portion of the water; it is known as an evaporative or wet cooling tower. The other type of tower transfers heat from the warmer water to cooler air by a sensible heat-transfer process and is known as a non-evaporative or dry cooling tower. While dry and wet cooling towers have their own advantages and disadvantages, the evaporative cooling tower has the potential for cooling the water therewithin to an approach temperature less than 5° F. above the wet-bulb temperature of the ambient air. A non-evaporative cooling tower does not usually have the capacity to cool the warm circulating water to within 5° to 10° F. of the temperature of the incoming air. Consequently, since in the present invention it is desirable as a practical matter to have the cooling tower cool the water therewithin to as low a temperature as possible, evaporative cooling towers appear to be the most easily adapted to the present apparatus, despite the fact that there is some loss of water vapor and drift from the tower. Other than the fact that evaporative cooling towers are preferred, the particular structure of the tower, itself, e.g., whether it uses atmospheric cooling, natural draft or mechanical draft to produce air-water contact, is not deemed of great importance at this time. What is important is that the cooling tower employed be such as will most efficiently lower the temperature of the water flowing therein to a temperature as close as possible of that of the ambient air.

Finally, the prior art also recognizes the use of water to cool the condenser of a chiller itself utilized to cool a space, such as a building. This can be accomplished by cooling the condenser water in a cooling tower and then exchanging the cooling capacity of that water in a heat exchanger through which the water from the chiller loop of a building also passes. Alternatively, the condenser water can also be used directly in the building water loop with a filtration system provided to strain foreign matter from the condenser water. Such a water system is disclosed in U.S. Pat. No. 3,995,443, and is marketed by Thermocycle International, Inc., of New York, N.Y. under the trademark Strainercycle.

Both of these approaches to the use of condenser water chilled in a cooling tower to thereafter provide chilled water to air condition a building, suffer from serious defects. It will be principally apparent that the requirement for cooling a building often will not coincide with the availability of water cooled by environmental (water tower) cooling. Thus, tower water will often be available only when the chiller is not in active operation, generally during the middle of the night when there is less need to provide cooling to a building, which may carry a heat load only during business hours.

It is, therefore, an important feature of the present invention is to store the cooling capacity contained in environmentally chilled water for use at another time when there is an air conditioning requirement that would normally have to be satisfied through mechanical means, the production of which has a high energy requirement. By using thermal energy storage, one can extend dramatically the number of hours environmentally chilled water can be substituted for mechanically refrigated water.

With regard to the mode in which the cooling capacity of environmentally chilled water can be stored, the use of eutectoid salt compositions has marked advantages over ice storage systems and chilled water storage systems. If not wholly inappropriate, ice storage systems are severly limited by the low temperatures they require to function. Cooling towers that chill condenser water simply do not produce water temperatures below 32° F. Chilled water storage is likewise inappropriate due to its space requirements and blending problems normally associated with it. Moreover, the inappropriateness of ice storage and chilled water storage for taking advantage of tower water coolness is emphasised by the fact that environmentally cooled water will vary to some extent as ambient dry and wet bulb temperatures vary. In a chilled water storage system, for example, varying inlet water temperature would exacerbate the blending problems markedly associated with chilled water storage. Hence, I am not aware of the employment of any kind of storage means for retaining the coolness of environmentally cooled water, although the concept of storing such thermal energy is most attractive as a low-energy means to air condition space in lieu of mechanical refrigeration.

SUMMARY OF THE INVENTION

The present invention takes the form of apparatus for storing the cooling capacity of a chilled liquid, which is usually water. In its basic form, it comprises the combination of a cooling tower for providing liquid at a temperature related to the dry and wet bulb temperatures of the ambient air. The apparatus also includes a storage tank containing packages of eutectoid salt compositions having a freezing-melting point above the temperature of the chilled liquid emerging from the cooling tower. The packages are spaced within the tank so that liquid, which enters through ingress means and exits through egress means in the tank, can flow through the tank in close proximity with the packaged salts. Conduit means connects the cooling tower and the tank, whereby liquid from the cooling tower passes into the tank by the ingress means, flows through the tank in close proximity to the packaged salts, and exits from the tank through the egress means, thereby freezing the packaged salts in the tank.

In an application of this apparatus to provide cooled liquid to a building having heat exchange means therein, the apparatus comprises the combination of a cooling tower and a storage tank as previous described. It further includes a chiller having conduits means for transporting liquid between the cooling tower and the condenser of the chiller, and conduit means for transporting liquid between the cooling tower and a building to be cooled. Finally, there is valve means for alternatively directing liquid between the cooling tower and the chiller, and between the cooling tower and the storage tank. More particularly, by the operation of valve means in the chiller conduit means, the storage tank conduit means and the building conduit means, environmentally cooled liquid can be directed from the cooling tower to the building, or to the storage tank, or to the chiller. The valve means can also function to direct water from the cooling tower to the storage tank to the chiller to the building and then from the building either directly back to the cooling tower or back to the chiller or back to the storage tank.

Regarding the packaged salt compositions within the storage tank, it is a feature of my invention that those packaged compositions can have differing freezing-melting points within the same storage tank. In this manner, if the environmentally cooled liquid is not at a low enough temperature to freeze all of the salts within the storage tank, it may be utilized at least to freeze some of the salt. In one embodiment, where there are salt compositions having different freezing points within a single storage tank, those packaged salts with the higher freezing points will be positioned at higher locations within the tank than packaged salts having lower freezing points. A similar result can be accomplished, although perhaps at greater expense, by having two or more storage tanks where the freezing point of the salts in one tank will be different than the salts in the other tank. When the tanks are arranged in series, the first tank can contain salt compositions having a lower freezing point than the salts in the further tank in the series. In this mode of my invention if the environmentally chilled water is sufficiently cold to freeze the salt compositions in the first tank, it will do so; in any case, it may be sufficiently cool to freeze the salts in the second or a later tank in the series.

PREFERRED EMBODIMENT OF INVENTION

While my invention has been described only in general terms hereinbefore, the above noted features and advantages will be more apparent when taken in connection with the best mode of my invention presently contemplated, which mode is diagrammatically illustrated in the accompanying drawing, in which the sole figure is a flow diagram of the invention using a storage tank preceding and in series with a chiller.

In accordance with my preferred embodiment, an evaporative cooling tower 10 of standard construction is provided to cool the condenser of a chiller 11 in more or less standard fashion. This function is accomplished by a chiller conduit means in the form of ducts directing the flow of liquid from cooling tower 10 to chiller 11. Such a chiller duct is designated by reference numeral 12; return flow duct 13 directs fluid, generally water, from the condenser of the chiller back to cooling tower 10. This is a standard mode of cooling the condenser of a chiller, and is well known in the art.

It is also known in the art that under certain conditions it may be possible to utilize water directly from the cooling tower 10 to cool a building or other space, identified by reference 14. By suitable valve means 15, water can be directed from the cooling tower 10 through building conduit means that includes duct 16, to cause a flow of water from the cooling tower 10 through a portion of duct 12 and then along duct 16 in the direction of arrow 17 to the building 14. This generally designated building conduit means then conducts the return flow of water in the direction of arrow 18 through ducts 17, 19 and 13 back to the cooling tower. As shown in the drawing, in the water to the building 14 and the heat exchange units located therein which utilize the cooling capacity of the chilled water to cool the building.

In another mode of operation of my preferred embodiment, the chiller 11 can be utilized if the chilled water that emerges from the storage tank 25 is not sufficiently cold to be operable with the heat exchangers in the building 14. It may well be, for example, that because of normal ambient conditions, the cooling tower 10 can lower the temperature of water that it emits to 48° F. In such case, for example, it may well be that only salt compositions having a freezing point of 52° F. and above can be frozen by that 48° water. As a consequence, when warm water is passed through the storage tank 25, the water emerging therefrom will have a temperature at or slightly above 52° F. If the heat exchange units of the building 14 are adapted to operate in conjunction with chilled water at 47° F., it will be apparent that if water from storage tank 25 is directed along chiller bypass circuit 30 and then back through conduit 16 to the building 14, the operation of the heat exchangers in building 14 will be less than optimum, because the water temperature is 5° F. too high.

In such circumstance the bypass circuit 30 is closed, and water flows directly from storage tank 25 into the chiller 11, which is operated to lower the temperature of the water by 5° F. From the chiller 11 the water flows through conduit 33 to conduit 16 and back to the building 14, the valve 31 being suitably adjusted. In this way the storage tank 25 utilizes the cooling capacity of cooling tower water, even if the ultimate temperature of that water is insufficient to pass directly to the building 14 and the heat exchange units therein.

While under normal circumstances the eutectoid salt compositions within the storage tank will all have the sam freezing-melting point by using the same eutectoid salt compositions it is possible to adjust the freezing-melting points of the compositions, packaged within the storage tank. It may be preferable to have those salt compositions have different freezing-melting points. One mode of accomplishing this function would be to have the layers comprising bottom one-third of the packages in the tank have a freezing-melting point of 47° F., a central layer having a freezing-melting point of 50° F., and upper zone of packaged compositions having a freezing-melting point of 53° F.

In this manner it is possible to utilize chilled water from the cooling tower regardless of variations in the temperature of that water during different seasons of the year or time of day. Thus, during winter months and dry conditions, it may well be possible to freeze all of the salts in the container, i.e., salts that freeze at 47° F., 50° F. and 53° F. However, during wet summer months it may not be possible to obtain cooling tower water low enough to freeze the 47° F. salts. In this circumstance, the water from the cooling tower may still be sufficiently cool to freeze the salts that freeze at 50° F., or 53° F. So, although under optimum conditions when all of the salts within the storage tank are frozen, it might be possible to bypass the chiller and directly pump water through the building conduit means from the storage tank to the building and back to the storage tank, during less than optimal conditions, when not all of the salts within the storage tank are frozen, such storage conditions may still be utilized and water pumped from the building through the storage tank, to the chiller and then back to the building, utilizing the chiller to make up for what ever cooling capacity the water from the storage tank lacks, but still utilizing the cooling capacity that is present in water being emitted from the storage tank. In this way one tank can effectively be utilized for different temperatures of water from the cooling tower.

It may also be desirable to utilize several storage tanks, each holding eutectoid salt compositions having different melting points so that the salt in at least one of the tanks is frozen. Indeed, if it is possible to sense the temperature of the water from the cooling tower, or to predict what that temperature will be from past performance charts, it is possible to utilize valve means to direct cooling tower water to the storage tank holding the eutectoid salt composition having the lowest freezing point capable of being frozen by such cooling tower water. According to economic facts, however, the use of a single storage vessel may still be the superior design, and it is presently contemplated that such a single vessel is the preferred design.

While my invention has been described herein in conjunction with a preferred embodiment thereof, which I present deem to be the best mode, it will be apparent to those skilled in this art that there are many other embodiments through which the invention can be effected. Exemplarily, the storage tank need not only be positioned in series with the chiller and before the chiller. It may be positioned in series after the chiller, or in parallel with the chiller. I wish to protect these and other obvious alternatives and modifications of my invention by the present application, which is to be limited only by the scope of the following, appended claims, including equivalents thereof.

What is claimed is:

1. Apparatus for storing the cooling capacity of a chilled liquid to provide cooled liquid to a building having heat exchange means therein, comprising the combination of a cooling tower for providing liquid at a temperature related to the dry and wet bulb temperatures of the ambient air, a chiller including a condenser and chiller conduit means for transporting liquid between said cooling tower and said condenser to cool the latter, building conduit means for transporting liquid between said cooling tower and said building heat exchange means to cool said building, a storage tank containing packages of eutectoid salt compositions and tank conduit means for transporting liquid between said tank and said cooling tower, and valve means in said tank conduit means and said chiller conduit means for alternatively directing liquid between said cooling tower and the condenser of said chiller to cool said conderser, and between said cooling tower and said tank to store coolness in said eutectoid salt packages.

2. Apparatus as claimed in claim 1, in which said packaged salt compositions have differing freezing-melting points.

3. Apparatus as claimed in claim 2, in which said packaged salt compositions having relativley high freezing-melting points are positioned at a higher location within said tank than packaged salt compositions having relatively low freezing-melting points.

4. Apparatus as claimed in claim 1, further including a second storage tank containing packages of eutectoid salt compositions in series with said one storage tank, *said packaged salt compositions in said second tank* having a different freezing-melting point from said compositions in said one tank.

5. Apparatus as claimed in claim 4, in which said one tank precedes said second tank in the flow of liquid from said cooling tower to said composition-containing tanks.

6. Apparatus as claimed in claim 4, in which liquid from said cooling tower is alternatively directed to said one or said second tank.

7. Apparatus as claimed in claim 5, in which the freezing-melting point of said compositions in said one tank is lower than the freezing-melting point of said compositions in said second tank.

8. Apparatus as claimed in claim 5, in which said valve means functions to direct water from said cooling tower to said storage tank to said chiller to said building.

9. Apparatus as claimed in claim 8, in which said valve means thereafter functions to direct said liquid back to said cooling tower from said building.

10. Apparatus as claimed in claim 8, in which said valve means thereafter functions to direct said liquid back to said chiller.

11. Apparatus as claimed in claim 8, in which said valve means thereafter functions to direct liquid back to said storage tank.

12. Apparatus for storing the cooling capacity of a chilled liquid to provide cooled liquid to a building having heat exchange means therein, comprising the combination of a cooling tower for providing liquid at a temperature related to the dry and wet bulb temperatures of the ambient air, a chiller including a condenser and chiller conduit means for transporting liquid between said cooling tower and said condenser to cool the latter, building conduit means for transporting liquid between said cooling tower and said building heat exchange means to cool said building, a storage tank containing packages of eutectoid salt compositions and tank conduit means for transporting liquid between said tank and said cooling tower, and valve means in said tank conduit means and said building conduit means for alternatively directing liquid between said cooling tower and said building, and between said cooling tower and said tank.

13. Apparatus as claimed in claim 12 in which said liquid is water.

14. Apparatus as claimed in claim 1, in which said liquid is water.

15. Apparatus as claimed in claim 1, in which said liquid is water.

16. Apparatus for storing the cooling capacity of a chilled liquid to provide cooled liquid to a building having heat exchange means therein, comprising the combination of a cooling tower for providing liquid at a temperature related to the dry and wet bulb temperatures of the ambient air, a chiller including a condenser and chiller conduit means for transporting liquid between said cooling tower and said condenser to cool the latter, building conduit means for transporting liquid between said cooling tower and said building heat exchange means to cool said building, a storage tank containing packages of eutectoid salt compositions and tank conduit means for transporting liquid between said tank and said cooling tower, valve means in said tank conduit means and said chiller conduit means for alternatively directing liquid between said cooling tower and the condenser of said chiller to cool said condenser, and between said cooling tower and said tank to store coolness in said eutectoid salt packages, and valve means in said building conduit means for alternatively directing liquid from said cooling tower to said building.

* * * * *